United States Patent [19]

Lippisch

[11] 3,990,275

[45] Nov. 9, 1976

[54] TAMPER-PROOF PADLOCK

[75] Inventor: Guillermo W. Lippisch, Park Forest South, Ill.

[73] Assignee: Junkunc Bros. American Lock Company, Crete, Ill.

[22] Filed: July 14, 1975

[21] Appl. No.: 595,598

[52] U.S. Cl. ..... 70/25; 70/322

[51] Int. Cl.[2] ..... E05B 37/10

[58] Field of Search ..... 70/25, 21, 24, 38 R, 70/38 A, 38 B, 38 C, 321, 322

[56] References Cited

UNITED STATES PATENTS

| | | | |
|---|---|---|---|
| 1,866,273 | 7/1932 | Sinner | 70/25 |
| 2,085,917 | 7/1937 | Mathes | 70/25 |
| 2,715,828 | 8/1955 | Mathes | 70/25 |
| 2,893,231 | 7/1959 | Soref | 70/25 |
| 3,009,345 | 11/1961 | Check | 70/21 |
| 3,194,033 | 7/1965 | Markert | 70/38 B |

*Primary Examiner*—Robert L. Wolfe

*Attorney, Agent, or Firm*—Hill, Gross, Simpson, Van Santen, Steadman, Chiara & Simpson

[57] ABSTRACT

Padlock constructed to resist efforts aimed at unauthorized opening of the padlock. The padlock casing has a rocker between the legs of the shackle of the padlock, and pivoted on a fixed pivot extending transversely of the padlock casing and held in a locking position by tumbler disks. A latch bolt is slidably carried by the rocker and biased by a spring to engage a latch bolt receiving notch in a shorter leg of the shackle. The rocker has an arcuate face struck from its pivot and facing oppositely from the latch bolt receiving notch of the shackle. The arcuate face slidably engages and cooperates with the arcuate face of a back-up fin or segment extending inwardly from the inner wall of the lock casing, backing up and forming a guide for said rocker. A camming and stop segment on the rocker slidably engages one side of the fin and comes into engagement with the lock casing to limit inward movement of the shackle, and to cam the rocker into a return direction.

11 Claims, 6 Drawing Figures

TAMPER-PROOF PADLOCK

BACKGROUND, SUMMARY AND ADVANTAGES OF INVENTION

Shackle-type padlocks having latch bolts spring-biased into locking engagement with a retaining notch formed in a leg of the shackle, to secure the shackle in locked condition into the padlock casing, have frequently been subjected to forceful and manipulative tampering schemes to open these padlocks. In many prior designs of such padlocks, such as the patents to Soref et al. U.S. Pat. Nos. 2,113,864; 2,487,608; 2,893,231; and Markert et al. U.S. Pat. No. 3,194,033, in which a spring-biased latch bolt slidably carried in a rocker secures the shackle in a locked position, intruders have discovered that cyclic or repetitive, continued force delivered to the shackle and transmitted to the latch bolt through the inclined face of the locking notch of the shackle, and the inclined face of the nose of the latch bolt could produce a reciprocating or vibratory motion of the latch bolt, brought into play by the elastic restoring force of the spring biasing the latch bolt into engagement with the shackle.

Where the reciprocating motion of the latch bolt produces a harmonic motion in the spring, and particularly where the rocker may have play, a progressively increased degree of reciprocation of the latch bolt is possible without a comparative increase in motion of the shackle, which is obviously restricted by the latch bolt. This has been achieved by continued tapping in synchronism with the natural frequency of the spring, whereby the elastic restoring force is reinforced by the impacts of the cyclic tapping force to a point where the latch bolt will "bounce" completely out of locking engagement with the shackle, whereupon the padlock can be opened.

The present invention, while providing the usual security associated with this type of lock, also overcomes the above-described deficiencies and short-comings relative to prior spring-biased latch bolt padlocks, by mounting the latch bolt for reciprocable movement in a pivoted rocker accommodating release of the latch bolt by the usual permutation or key-operated mechanism, and by providing the rocker with an arcuate face struck about the axis of pivotal movement of the rocker, and slidably engaging a stabilizing fin extending inwardly from the lock casing, and with a stop segment limiting movement of the rocker in a release direction and cooperating with the latch bolt to limit inward movement of the shackle. The fin and segment cooperate to retain the rocker from vibratory motion as well as relieve the pivot for the rocker from excess shear. The latch bolt has a face converging toward its nose and forming a notch engaged with the face of the rocker facing the short leg of the shackle, and limiting retractable movement of the latch bolt as release of the shackle is attempted by forceful pulling on the shackle.

An advantage of the present invention, therefore, is in the stabilizing means and stop for the rocker and shackle for a permutation-type padlock which overcomes the deficiencies and short-comings of the prior art.

A further advantage of the present invention is in the simplicity and effectiveness of the safeguard means to solve the deficiencies of spring-biased latch bolts.

Still another advantage of the invention resides in the cooperation between the safeguard means and the key cylinder release mechanism.

A still further advantage of the invention resides in the relief of the pivot pin for the rocker from excess shear.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure.

DESCRIPTION OF PREFERRED EMBODIMENT OF INVENTION

Figure 1:
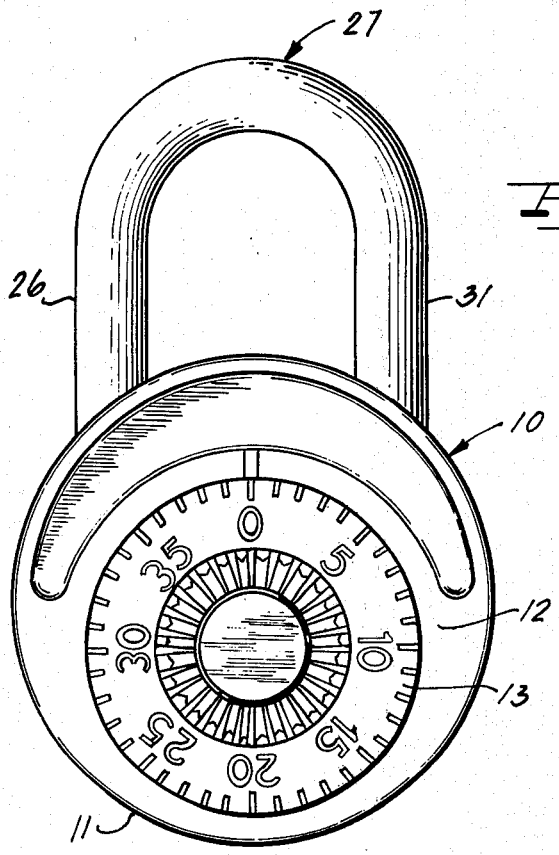
FIG. 1 is a front end view of a permutation and key-operated padlock constructed in accordance with the principles of the present invention.
Figure 2:
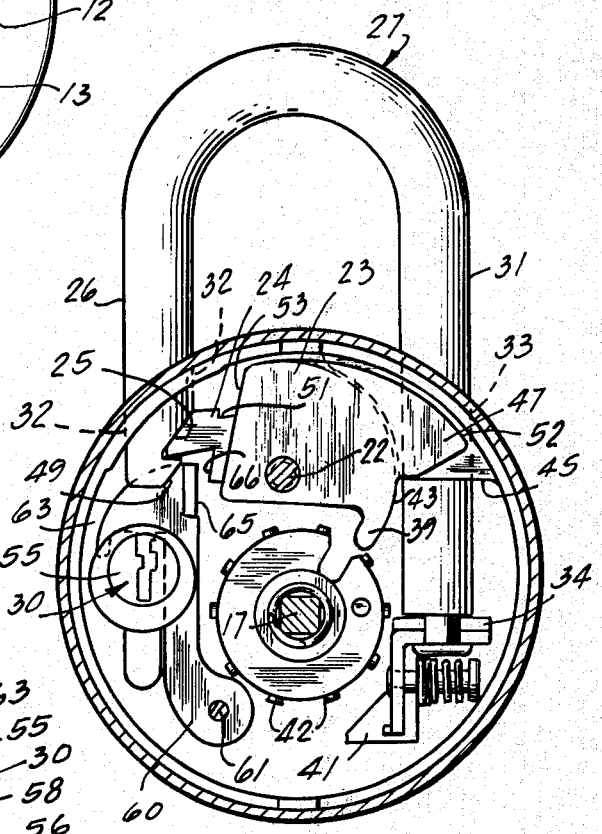
FIG. 2 is a sectional view taken through one side of the casing of the padlock shown in FIG. 1, looking at the padlock from the front and showing the padlock in a locked condition.
Figure 3:
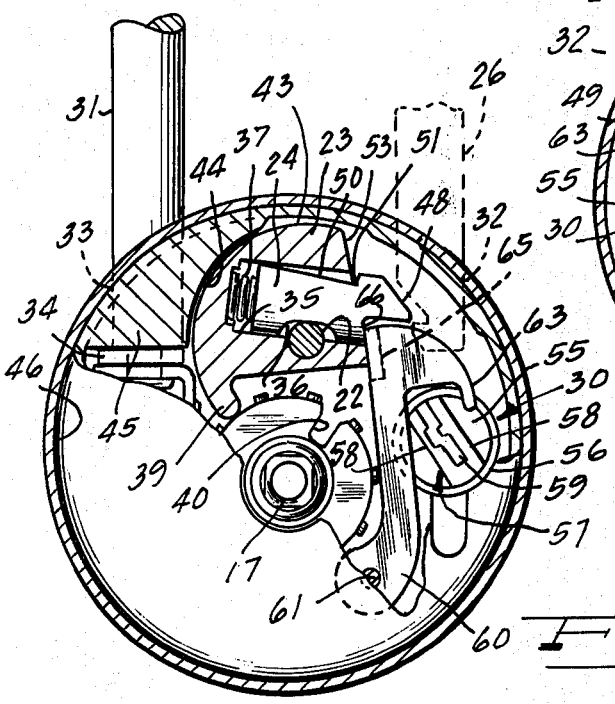
FIG. 3 is a sectional view taken through the padlock, but looking at the padlock from the opposite side of the padlock from FIG. 2, and showing the latch bolt in a released position by the key cylinder and release lever of the padlock.

In the embodiment of the invention illustrated in the drawings, a lock casing 10 of a generally cylindrical form is shown having an outer casing 11 with a recessed front plate 12 for receiving a combination dial 13. An inner casing 15 extends within and generally conforms to said outer casing. A rear plate 16 closes said inner casing and forms a support for a spindle 17 for permutation disks 18, 19 and 20, and for a pivot pin 22 for a rocker 23. The dial 13 and disks 18, 19 and 20 are of a conventional form and are no part of the present invention, except insofar as they form a means for accommodating pivotal movement of the rocker 23, to release a latch bolt 24, reciprocably mounted in said rocker, from a locking notch 25 in a short leg 26 of a shackle 27. The rear plate 16 also forms a pivotal support for a key cylinder means 30 disposed to one side of the permutation disks 18, 19 and 20, as shown in FIGS. 2 and 3. The shackle 27 is a conventional form of generally U-shaped shackle having a short leg 26, having the locking notch 25 therein, and having a long leg 31, slidably extending through openings 32, 33 in the walls of the casings 11 and 15. The shackle 27 is thus supported and guided for extensible and retractable movement relative to the inner and outer casings. A guide plate 34, suitably mounted on the inner end of the long leg 31 of the shackle forms a guide for said shackle as in U.S. Pat. No. 2,926,514 which issued to George P.

Junkunc on Mar. 1, 1960. The longer leg 31 of the shackle thus provides extensible guided movement of the shackle 27 to accommodate opening of the padlock by withdrawing the short leg 26 from the opening 32 upon release of the latch bolt 24 from the locking notch 25 in the short leg of the shackle.

The rocker 23 comprises a rocker and support for the latch bolt 24 and, as previously mentioned, is rockingly supported on the transverse pin 22. The latch bolt 24 is slidably received in a recess or hollow portion 35 in the rocker 23. The recess opens toward the locking notch 25 in the short leg of the shackle. The recess and latch bolt may be rectangular in cross section, to prevent tilting movement of the latch bolt relative to the rocker, although they need not necessarily be rectangular in cross section, but may be of generally cylindrical forms, if desired.

Figure 5:
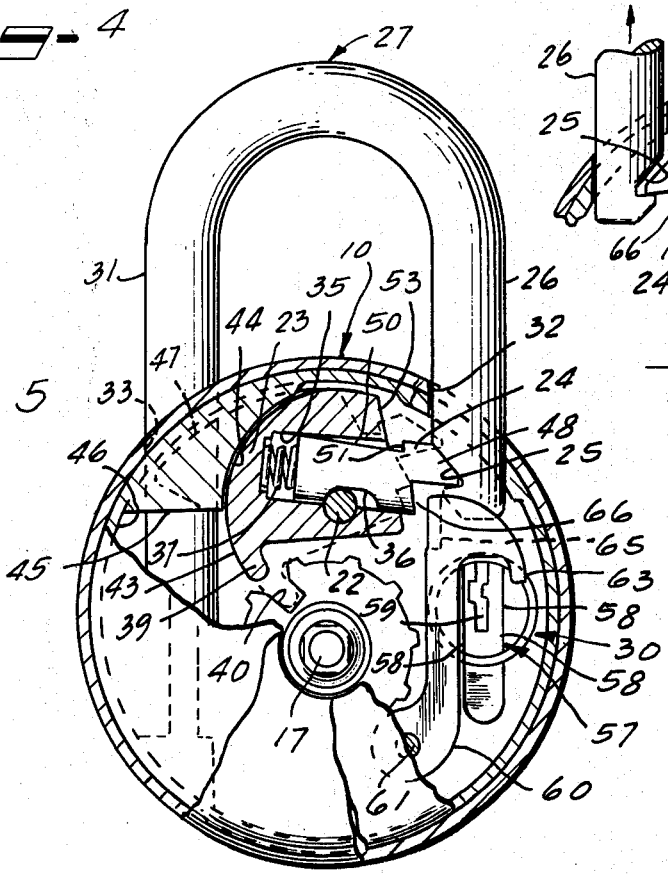
FIG. 5 is a sectional view somewhat similar to FIG. 3, but taken through the opposite side of the padlock from FIG. 3, and showing the rocker and latch bolt in position to be released upon outward pulling movement on the shackle, and showing the latch bolt and rocker in their fully released positions in dotted.
Figure 6:
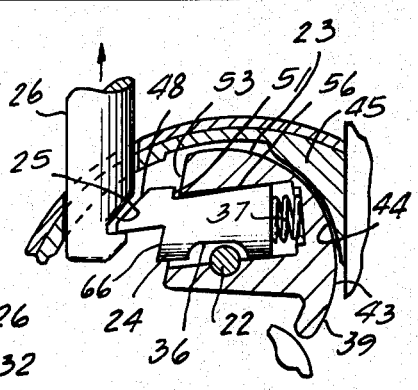
FIG. 6 is an enlarged fragmentary sectional view showing the latch bolt in one of its locking positions.

As shown in FIGS. 3, 5 and 6, the latch bolt 24 has a bottom opening notch 36 therein extending over the pivot pin 22 and limiting rectilinear movement of said latch bolt along said recess. A compression spring 37 seated in the recess 35 serves to extensibly move a nose 48 of the latch bolt into the locking notch 25 in a conventional manner.

As seen in the drawings, a tongue 39 depends from the lower portion of the rocker 23 and is spaced from the pivot 22 thereof towards the long leg of the shackle for engagement with the peripheral surfaces of one or more of the permutation or tumbler disks 18, 19 and 20, to restrict the latch bolt 24 to a shackle securing orientation, whenever the disks 18, 19 and 20 and slots 40 in said disks are out of alignment with each other. The permutation or tumbler disk 18 is usually termed a driving disk and is turned by the combination dial 13 to rotatably drive a next adjacent tumbler disk 19, which in turn may drive a tumbler disk 20 to align the slots 40 in said tumbler disks as shown in FIG. 5 to accommodate the tongue 39 to enter the aligned slots 40. When the slots 40 are in registry with each other in position to admit the tongue 39 of the rocker 23, an outward pull on the shackle 27 will pivot the rocker 23 about the pin 22 and move the tongue 39 into the slots 40 and thereby bring the latch bolt 24 out of locking engagement with the notch 25 in the short leg 26 of the shackle.

It may be seen from FIGS. 2 and 5 that when the shackle 27 is again depressed into the casing 10, the shackle leg 26 will cam the latch bolt 24 against the bias of the spring 37 to re-establish locking engagement between the latch bolt 24 and the notch 25 of the short leg 26 of the shackle. During this retractable movement of the shackle 27 into its locked position, an upsetter 41 on the lower end of the long leg of the shackle, spaced downwardly of the guide disk 34, serves to engage spaced lugs or radial projections from the tumbler disks to bring the slots 40 out of registry with each other.

The tumbler disk construction and arrangement and upsetter are similar to those shown in U.S. Pat. No. 2,926,514 which issued to George P. Junkunc on Mar. 1, 1960, and incorporated herein as a part of this specification, so not herein shown or described further.

Referring now in particular to the stabilizing means for the rocker 23, relieving the pivot pin 22 from excess shear and reacting against the latch bolt 24 to reduce reciprocatory motion of the latch bolt 24 against the spring 37, by cyclic tapping on the latch bolt and thereby prevent unauthorized opening of the padlock without a key, it has been found that where the rocker 23 is guided and backed and limits movement of the shackle inwardly of the lock casing, that the rocker is sufficiently stable, and retractable movement of the latch bolt is so limited as to reduce vibrations of the latch bolt caused by cyclic tapping on the shackle, and thereby cannot be released in this manner as long as stability of the rocker is established and inward movement of the shackle relative to the lock casing is limited. The backing up of the rocker also assures against release upon excessive pull on the shackle.

As shown in FIGS. 2, 3, 5 and 6, the rocker 23 has an arcuate face 43 facing toward the long leg of the shackle and struck from the center of the pivot pin 22 and shown as extending along said rocker to substantially the end of the tongue 39. The arcuate face 43 slidably engages a corresponding concave back-up face 44 on a back-up fin and guide 45 extending inwardly of an internal cylindrical wall 46 of the inner casing 15. The back-up face 44 thus forms a back-up surface and guide for the rocker 23 and has sliding back-up engagement therewith during all positions of movement of said rocker.

A stabilizing and stop segment 47 extends from and is formed integrally with the rocker 23 and extends along one side of the fin 45 to further stabilize rocking movement of said rocker and cooperate with the arcuate face of the fin 45, to provide lateral stability to the rocker 23 as it pivots about the pin 22. The stop segment 47 has an outer arcuate face 52 eccentric of the pivot of said rocker and shown as conforming to the internal wall of the inner casing 15 when the rocker is in its released position, and engaging said wall at its enlarged end on movement of the rocker 23 in a direction which in FIG. 2 would be a counterclockwise direction to form a stop for inward movement of said shackle.

The arcuate face 43 of the rocker 23, cooperating with the corresponding concave face 44 of the stabilizing fin 45 and the stabilizing and stop segment 47 for said rocker, all cooperate to relieve the pivot pin 22 from twisting forces and back up the rocker and give it both lateral and radial stability at all times.

The segment 47 may also tend to cam the rocker 23 and shackle 27 in a return direction after reaching the stop position.

The backing up of the rocker by the arcuate face 44 is effective in all positions of movement of the rocker, as may clearly be seen in FIGS. 2, 3, 5 and 6 and provides a firm support for the rocker in cooperation wth the pivot pin 22 and guides and backs the rocker from radial movement relative to its center. Cyclic reciprocable movement of the latch bolt, caused by cyclic tapping on the shackle, producing harmonic motion of the spring 37 to the extent that the latch bolt will "bounce" out of locking engagement with the shackle, is also obviated by the stabilizing and stop segment 47.

The nose 48 terminates into an inclined camming surface camming said nose in a retracted position by a lower inclined camming surface 49 of the shackle leg 26, to effect retractable movement of the latch bolt as the padlock is closed by inward movement of the leg 26 of the shackle within the lock casing. The latch bolt also has an inclined upper surface 50 receding as it progresses toward the nose 48, and terminating into a shoulder 51, defining a rear stop surface for the nose 48. The shoulder 51 is provided to stop retractable latch bolt displacement and engages a front face 53 of the rocker 23 to bring about locking engagement therebetween as the latch bolt is angularly moved relative to the rocker 23 upon outward forceful movement of the shackle, as shown in FIG. 6, to further prevent unauthorized opening of the padlock. The back-up fin 45, as well as the stabilizing and stop segment 47, thus provide the rocker 23 with a firm support independently of the pin 22 and relieve the rocker from any tendency to move radially or angularly as the tongue 39 is in engagement with the peripheral surface of one or more of the tumblers 18, 19 or 20 and form a stop limiting inward movement of the shackle relative to the padlock casing. These features, as well as the shoulder 51 cooperating with the plane front face 53 of the rocker 23, all cooperate to form a safeguard against unauthorized opening of the padlock.

Figure 4:
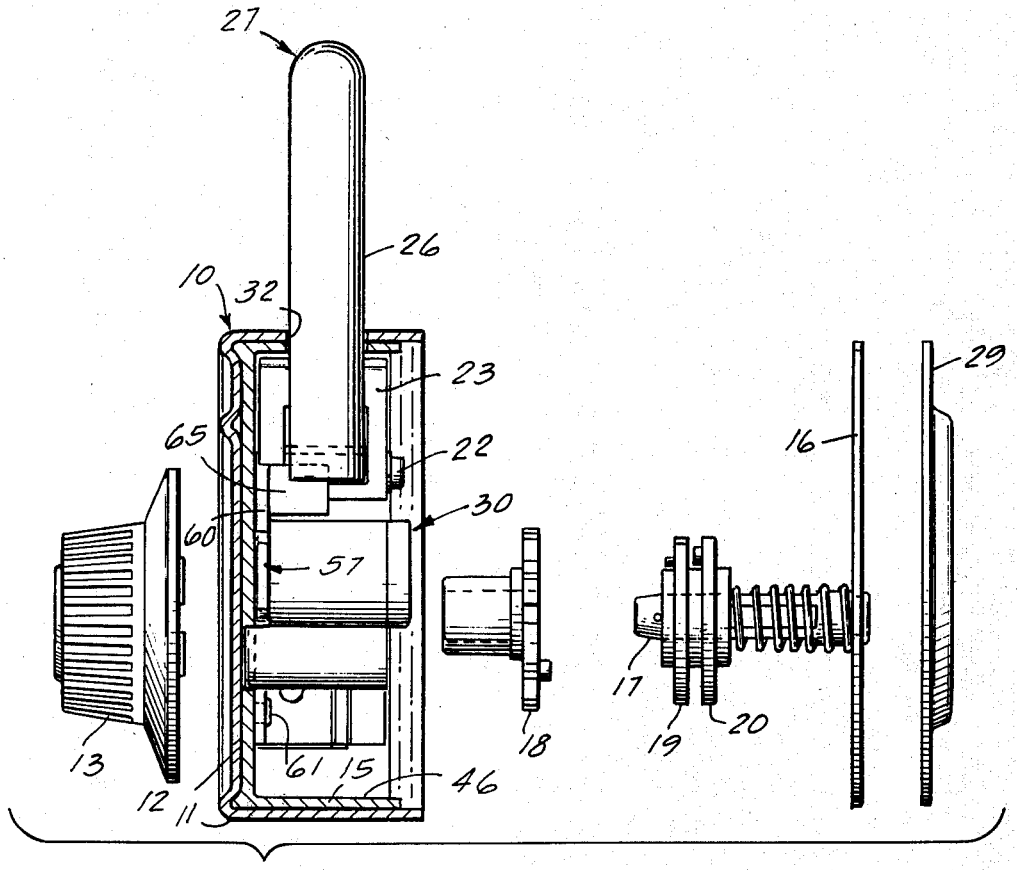
FIG. 4 is an exploded view of the padlock with the lock casing shown in section to expose the latching mechanism.

The key cylinder means forms an alternate release means for the latch bolt from the locking notch 25, which is complementary to the stabilizing and safeguard means, preventing unauthorized opening of the padlock, and includes a key plug 55 rotatably mounted in a key cylinder 56 carried by the front plate of the inner casing 15 and the rear plate 16 of said inner casing. The release means also includes a rectangular extension 57 from the key plug 55 having parallel camming faces 58 and a key slot 59 therein. One face 58 is engageable with a release lever 60, pivoted on the inner wall of the inner casing 15, on a pivot pin 61, disposed beneath and to one side of the tumblers, as clearly shown in FIGS. 3 and 4. The release lever 60 extends outwardly and upwardly of the pivot pin 61, as shown in FIGS. 4 and 5 along the inside of the front plate of the inner casing 15 and along one surface 58 of the extension or camming projection 57 of the key cylinder, into position directly beneath the nose 48 of the latch bolt. The lever then extends outwardly about the extension 57 and has a depending lip 63 spaced from, but extending along, the outer face of the camming extension 57 and engaging a face 58 thereof to move the release lever into release position, as shown in FIG. 5. The release lever 60 also has an inwardly extending projection 65 extending inwardly along a receding camming face 66 of the latch bolt, disposed beneath and spaced inwardly of the nose 48 thereof.

Upon the placing of a key in the key slot 59 and turning movement of the key cylinder and camming extension 57 in a direction, which in FIG. 3 is a counterclockwise direction, the projection 65 will engage the receding camming face 66 and retractably move the latch bolt within its recess 35. The shackle 27 may then be extended from the padlock casing to remove the short leg of the shackle therefrom and then turn the shackle to release the padlock.

It may be seen from FIG. 3 that the pivot 61 of the release lever 60 is so spaced relative to the projection 65 that the actuating force applied by the lever 60 is at a downward inclination when the padlock is in the position shown in FIG. 3, to position the shoulder 51 beneath the top surface of the recessed portion of the rocker 23 and accommodate complete release of the latch bolt from the locking notch 25. The short leg of the shackle may then be withdrawn from the casing 10.

Upon removal of the key from the key cylinder, the key cylinder is usually turned to position the key slot 59 upright. The outer face 58 of the projection 57 will then cooperate with the depending lip 63 of the lever 60 and spring 37, to return the lever 60 into the upright position shown in FIG. 5 alongside of an inner face 58 of the rectangular extension 57 of the key cylinder.

It may be seen from the foregoing that a simplified and improved combination tumbler and key-operated padlock has been provided in which the shackle 27 is safeguarded against unauthorized opening by forceful and manipulative tampering schemes heretofore employed against prior padlocks and that the safeguard is particularly effective for a padlock released by permutation mechanism and for a combination permutation and key-operated release padlock.

I claim as my invention:

1. In a padlock safeguarded against tampering, a casing having a pair of parallel spaced openings therein, a U-shaped shackle slidably carried in said openings and including a long leg and a parallel shorter leg, the shorter of said legs having a latch bolt receiving notch therein, a rocker assembly pivotally mounted within said casing between said legs and having a latch bolt slidably carried therein and extensible therefrom for engagement with said locking notch of the shorter leg of the shackle, a spring seated in said rocker and biasing said latch bolt to engage said latch bolt receiving notch, release means to accommodate release of said latch bolt from said shackle and opening of the padlock, said rocker having an arcuate face struck from the pivot thereof and facing the long leg of the shackle, and back-up means backing up said rocker and guiding and stabilizing movement of said rocker and relieving the pivot thereof from excess shear, comprising a stabilizing fin within said lock casing and extending inwardly from an interior wall thereof, having an arcuate face struck from the pivot of said rocker and having slidable engagement with said rocker and backing up said rocker and limiting radial movement thereof, to provide a firm support for said latch bolt in its locked position and obviate release of said latch bolt by cyclic tapping on the shackle, in synchronism with the natural frequency of said spring, which would cause progressive reciprocation of the latch bolt to the point where the latch bolt will bounce out of locking engagement with the shackle and thereby accommodate unauthorized opening of the padlock.

2. The padlock of claim 1 including means on said rocker cooperating with said casing, limiting inward movement of said shackle relative to said casing and forming a stop for said rocker.

3. The padlock of claim 2 wherein the means on said rocker limiting inward movement of said shackle relative to said casing comprises a segment extending from said rocker along one side of said stabilizing fin and having an outer arcuate face parallel to the inner wall of said lock casing when said padlock is locked, and coming into engagement with the inner wall of said lock casing upon inward movement of said shackle beyond the locked position of said latch bolt to form a stop for said rocker, latch bolt and shackle.

4. The padlock of claim 1 wherein said rocker has a plane face facing the shorter leg of the shackle, and said latch bolt has a beveled nose engageable with said latch bolt receiving notch in said shackle and an inclined upper surface converging toward the outer end of said rocker, but stopping short of said nose to accommodate axial movement of said latch bolt relative to said rocker and form a notch engageable with said rocker, upon outward movement of said shackle, axially tilting said latch bolt relative to said rocker and preventing retractable movement of said latch bolt relative to said rocker by outward forceful movement on said shackle.

5. The padlock of claim 4 wherein the release means comprises a series of permutation disks having radial slots therein retaining said rocker and latch bolt in a latching position and accommodating rocking movement of said rocker and latch bolt into released positions when said radial slots are in aligned relation with respect to each other, and has key-operated release means for said latch bolt releasing said latch bolt when said rocker is held by said disks in a shackle latching position.

6. The padlock of claim 5 wherein the key-operated release means comprises a key cylinder in said casing closely adjacent an inner wall of said casing, a transmission lever pivoted to said casing beneath said rocker and key cylinder and extending along said key cylinder and having a portion extending in position to engage said latch bolt beneath said nose, and wherein said key cylinder has an extension having parallel camming faces, one face engaging said lever intermediate its ends, and moving said lever in a latch release direction, and said lever having a portion extending over said extension, with a lip depending therefrom and engaged by the other of said camming faces to positively move said lever in a direction to release said latch bolt to move to a locking position as said key cylinder is turned into position to remove its key therefrom.

7. The padlock of claim 5 wherein said nose terminates into a lower inwardly extending plane face, and wherein said inwardly extending plane face terminates into an inclined depending camming face cooperating with said lever to hold said latch bolt from axial movement relative to said rocker and accommodate full retractable movement of said latch bolt into its shackle release position.

8. A tamper-proof padlock comprising, a casing having a pair of parallel spaced shackle receiving openings therein, a U-shaped shackle slidably carried in said openings, a locking notch in a shorter leg of said shackle, a rocker disposed between said legs and having a hollow portion opening towards said locking notch, a latch bolt slidably mounted in said hollow portion, a spring biasing said latch bolt to engage said locking notch, a pivot pin for said rocker and retaining said latch bolt to said hollow portion, said latch bolt having a nose engageable with said locking notch and having an inclined top surface extending rearwardly of said nose, said inclined top surface of said latch bolt terminating into a shoulder engageable with said rocker upon rocking movement of said latch bolt caused by outward pulling movement on said shackle, when said latch bolt is in locking engagement with said shackle, to hold said latch bolt from retractable movement relative to said rocker and to thereby prevent release of said latch bolt from said shackle upon outward pulling movement on said shackle when said latch bolt is in locking engagement with said shackle, combination and key-operated release means for said latch bolt and shackle, means backing up said rocker, and other means limiting inward movement of said shackle in cooperation with said latch bolt when in a locking position by stopping pivotal movement of said rocker in a direction opposite to its release direction, to the extent sufficient to obviate release of said latch bolt by cyclic tapping on said shackle, in synchronism with the natural frequency of said spring, which would cause progressive reciprocation of said latch bolt to the point where it will bounce out of locking engagement with said shackle.

9. The padlock of claim 8, wherein the means limiting inward movement of said shackle comprises a segment extending from said rocker and having a camming and stop face engageable with said casing upon predetermined inward movement of said shackle.

10. The padlock of claim 9 wherein the means backing up said rocker comprises a stabilizing fin within said lock casing and extending inwardly of an interior wall thereof and having an arcuate face struck from the pivot of said rocker and having slidable engagement with said rocker to the full extent of rocking movement thereof.

11. The padlock of claim 10 wherein the segment extending from said rocker extends along one side of and slidably engages said stabilizing fin and has an outer arcuate surface conforming to the interior wall of said casing, and engages said casing by the eccentricity of the pivot thereof relative to the outer arcuate surface of said segment.

* * * * *